US006743158B2

(12) United States Patent
Giannelli et al.

(10) Patent No.: US 6,743,158 B2
(45) Date of Patent: Jun. 1, 2004

(54) LEG PRESS

(75) Inventors: Raymond Giannelli, Franklin, MA (US); Scott Sechrest, Providence, RI (US); Arnold Gillen, Fariboult, MN (US); Gary Lurken, Owatonna, MN (US); Stephen C. Wendt, Owatonna, MN (US)

(73) Assignee: Cybex Interational, Inc., Medway, MA (US)

( * ) Notice: Subject to any disclaimer, the term of this patent is extended or adjusted under 35 U.S.C. 154(b) by 125 days.

(21) Appl. No.: 09/789,071

(22) Filed: Feb. 20, 2001

(65) Prior Publication Data

US 2002/0013199 A1 Jan. 31, 2002

Related U.S. Application Data

(60) Provisional application No. 60/186,138, filed on Mar. 1, 2000.

(51) Int. Cl.[7] ..... A63B 21/062; A63B 21/068; A63B 23/04

(52) U.S. Cl. ..... 482/96; 482/135; 482/101; 482/142

(58) Field of Search ..... 482/92–101, 79, 482/130, 135–137, 132; 472/118, 124, 131, 135

(56) References Cited

U.S. PATENT DOCUMENTS

| | | | | |
|---|---|---|---|---|
| 2,455,548 A | * | 12/1948 | Bell | 482/96 |
| 2,714,507 A | * | 8/1955 | Goodrich | 482/72 |
| 4,176,836 A | | 12/1979 | Coyle | |
| 4,915,378 A | | 4/1990 | Abrahamian et al. | |
| 5,106,081 A | | 4/1992 | Webb | |
| 5,411,458 A | | 5/1995 | Giust | |
| 5,437,589 A | | 8/1995 | Habing | |
| 5,464,378 A | * | 11/1995 | Yu | 482/95 |
| 5,547,444 A | * | 8/1996 | Huang | 482/72 |
| 5,554,086 A | | 9/1996 | Habing et al. | |
| 5,626,542 A | * | 5/1997 | Dalebout et al. | 482/96 |
| 5,669,865 A | * | 9/1997 | Gordon | 482/142 |
| 6,287,241 B1 | | 9/2001 | Ellis | |

* cited by examiner

*Primary Examiner*—Nicholas D. Lucchesi
*Assistant Examiner*—Victor Hwang
(74) *Attorney, Agent, or Firm*—Kudirka & Jobse, LLP

(57) ABSTRACT

An exercise apparatus that includes a frame, a rest member on the frame for receiving a user's feet, and a first and a second arm that are pivotably interconnected to each other such that the arms are pivotably movable between a start or rest position and an extended position. The first arm is coupled to the frame. A seat is provided for supporting the user and carried by the second arm. An inclined base support member is disposed under the second arm and is for supporting the second arm during the movement between start and extended positions. A carriage may be associated with the inclined base support member.

30 Claims, 5 Drawing Sheets

LEG PRESS

CROSS REFERENCE TO RELATED APPLICATIONS

This application claims priority under 35 U.S.C. Section 119 to U.S. Provisional Application Serial No. 60/186,138 filed Mar. 1, 2000 the disclosure of which is incorporated herein by reference in its entirety.

BACKGROUND OF THE INVENTION

1. Field of the Invention

The present invention relates generally to the field of exercise equipment, and pertains, more particularly, to an apparatus for performing a leg press exercise. In an embodiment of the invention, the apparatus of the present invention may be attached to a multi-station exercise machine.

2. Discussion of the Related Art

In the past, there have been developed many different types of exercise machines used for strengthening the muscles of a user. One type of machine is traditionally referred to as a "leg press". One type of leg press machine employs a seat mounted in a frame, in combination with a push plate that moves relative to the frame. In use, the user, once seated, pushes the plates with their legs so that the plates move from a start position to an extended position. The push plate is typically connected to some type of exercise resistance means so as to provide a reactive force to the pushing motion of the user. It is typical to use a weight stack with a pre-determined number of these weights being selected for lifting when the push plate is moved forward toward it's extended position. The weight stack may be coupled to the push plate by a cable and pulley arrangement. Presently, there are a variety of different types of leg press exercise apparatus presently available.

Another form of leg press employs a frame, a seat, and a rest member for receiving the user's feet. In this type of machine, the rest member is stationery and the seat is movable by means of a linkage. An example of a machine of this type is disclosed in U.S. Pat. No. 5,554,086 to Habing, et al.

Many of these past machines are relatively complicated in structure, sometimes requiring complicated linkages and rigging members. Accordingly, they tend to be relatively expensive. Moreover, most of these machines do not provide for the optimal body position, particularly, between start and extended positions.

SUMMARY OF THE INVENTION

The present invention provides an exercise apparatus, particularly for leg presses and in which the apparatus is relatively simple in construction, relatively inexpensive, and provides for the maintaining of a more optimized body position throughout the transition from a start position to an extended position and back. This optimized body positioning allows for the rearward rotation of the torso as it translates through the path of motion, to allow for a substantially increased range of motion of the user's hip during the exercise. In accordance with one aspect of the present invention, there is provided a reversibly extending exercising apparatus that comprises a first arm and a second arm pivotably interconnected to each other such that the interconnected arms are pivotably movable between a start position and an extended position. The first arm may be pivotably supported from an apparatus frame, while the second arm is slidably or rollably supported on a support guide mechanism. In this way, the second arm is supported for movement along a predetermined path of travel, preferably inclined relative to horizontal, between the start and extended positions.

In accordance with another aspect of the present invention, there is provided a leg press exercise apparatus that comprises a frame, a rest member on the frame for receiving and supporting a user's feet, and a first arm and a second arm that are pivotably intercoupled to each other such that the arms are pivotably movable between a start position and an extended position. The first arm is coupled to the frame, preferably adjacent of the rest member. A seat is provided for supporting the user and is carried by the second arm. An incline base support member is disposed under the second arm and is for supporting this second arm during the movement between start and extended positions.

In accordance with the invention there is also provided an apparatus comprising: a frame; a rest member on said frame for receiving a user's feet; a first arm and a second arm that are pivotably intercoupled to each other such that the arms are pivotably movable between a start position and an extended position; said first arm coupled to said frame; a seat for supporting a torso of the user and carried by said second arm; and an inclined base support member disposed under said second arm for supporting the second arm during movement between the start and extended positions. The first arm is pivotably coupled to said frame, the second arm following the inclined base support between the start and extended positions such that the torso of the user is rotated rearwardly relative to horizontal during movement between the start and extended positions. The frame preferably includes an upright support piece having at the top end thereof a pivot member for coupling said first arms to said frame. The apparatus preferably includes a pivot member for intercoupling the first and second arms such that the torso of the user is translated rearwardly away from the rest member during movement between the start and extended positions. The apparatus preferably includes a carriage supported on said inclined base support member wherein the carriage at one end thereof includes a pivot member for pivotally supporting the carriage from said second arm. The carriage typically comprises spacedly disposed side plates interconnected by a lower guide member and an upper guide member.

Further in accordance with the invention there is provided a reversibly extending exercise apparatus comprising: a pair of pivotably interconnected arms on which a subject is mountable on a chair mechanism; a support and guide mechanism forming a part of a frame of the apparatus; wherein the support and guide mechanism support one of the pair of pivotably interconnected arms; wherein the arms are reversibly extendible by forcible extension of the legs of the subject between a rest position and an extended position; the arms being extendible such that the subject is positioned in an upwardly prone position at all times between the rest and extended position.

DETAILED DESCRIPTION

Figure 1:
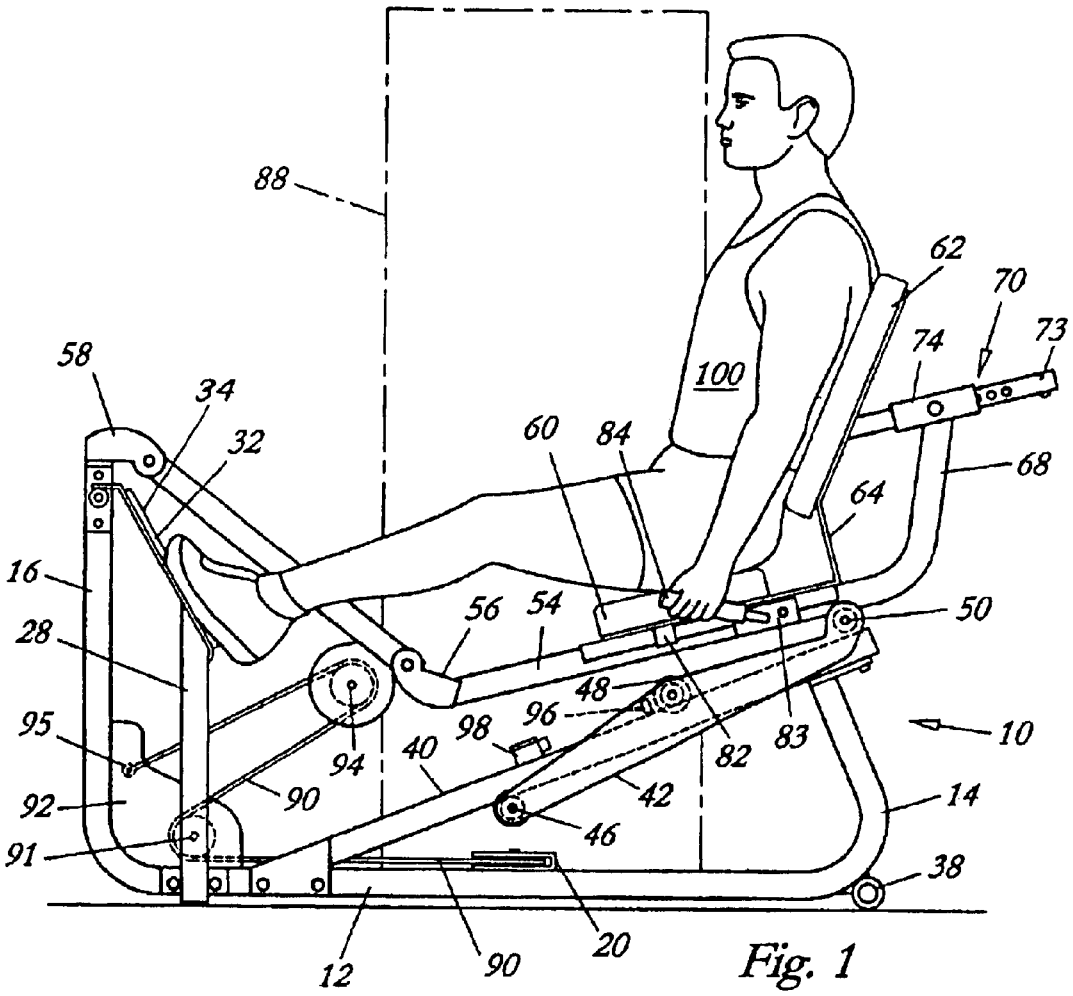
FIG. 1 is a side elevation view of a preferred embodiment of exercise apparatus of the present invention.
Figure 2:
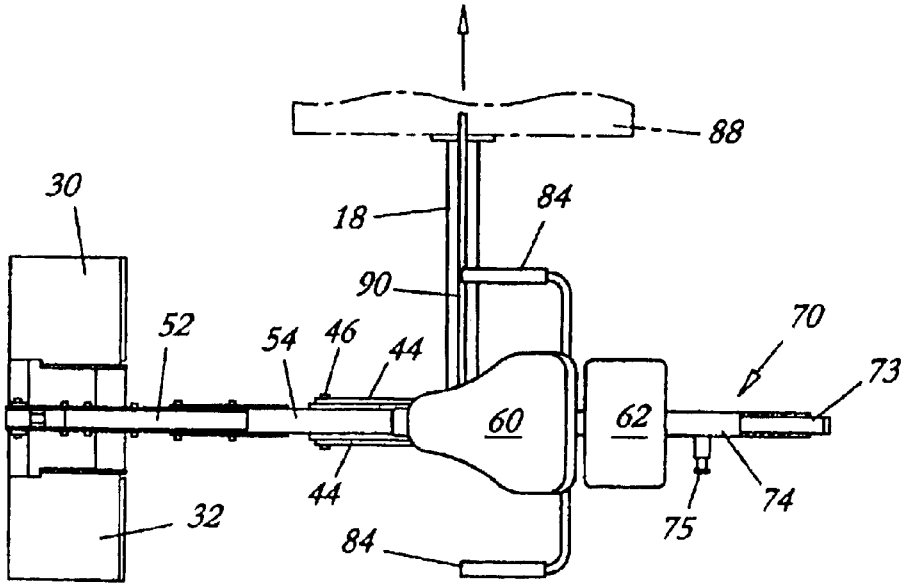
FIG. 2 is a top plan view of the exercise apparatus of FIG. 1.

Reference is now made to the drawings herein, particularly FIGS. 1–6 which illustrate a preferred embodiment of the leg press apparatus of the present invention. The apparatus comprises a frame 10 preferably constructed of metal. The frame is comprised of a number of different components, many of which are of square or U-shaped metal cross section. The frame 10 includes an elongated base piece 12 having at one end a curved section 14 and at its other end connects to an upright support piece 16. An extension member 18 is secured at about the middle of base piece 12 as noted in, for example, FIG. 4. A pulley 20 is supported at a position where the extension member 18 is secured to the base piece 12.

At the end of the base piece 12 where the upright support piece 16 is secured, there is also provided a U-shaped support member 24. Member 24 has upstanding support members 26 and 28. These support members 26 and 28, at the respective tops thereof, support leg plates 30 and 32. Each of these leg plates 30 and 32 may carry a hard rubber pad 34, such as shown in either FIG. 1 or FIG. 3.

To stabilize the apparatus, frame 10 and its various members employ stabilizer legs. These are in the form of cylindrical members 38. These are shown, for example, in FIG. 4, two being attached to the U-shaped support member 24, and one being attached to the frame between the base piece 12 and the curved section 14. The stability of the apparatus is also enhanced by the extension member 18 extending from the base piece 12.

An inclined support member 40 is provided. Member 40 extends from the base piece 12 to the top of the curved section 14. The inclined support member 40 functions as a fixed rail for the carriage 42.

The carriage 42 comprises two side plates 44, one disposed on each side of the incline support member 40. These side plates are interconnected by a lower guide member 46 and by an upper guide member 48. The carriage 42 is also pivotably connected to the arm structure which is to be described in further detail hereinafter. This connection, as noted in the figures, is at pivot 50.

As indicated previously, in addition to the frame 10 and rest members, namely leg plates 30 and 32, there is also provided a pair of arms that are pivotably interconnected to each other such that the arms are pivotably movable between a start position and an extended position. In the drawings, these are identified as arms 52 and 54. These arms 52 and 54 are interconnected at a common end at the pivot member 56. The top end of arm 52 is also pivoted at pivot member 58 such as shown in the somewhat schematic diagram of FIG. 5. Pivot 58 is secured at the top of the upright support piece 16. Refer also to the enlarged side elevation view of FIG. 3 which shows the pivot member 58 with the arms 52 and 54 in solid and dotted position indicating two different positions of the linkage arms.

Figure 4:
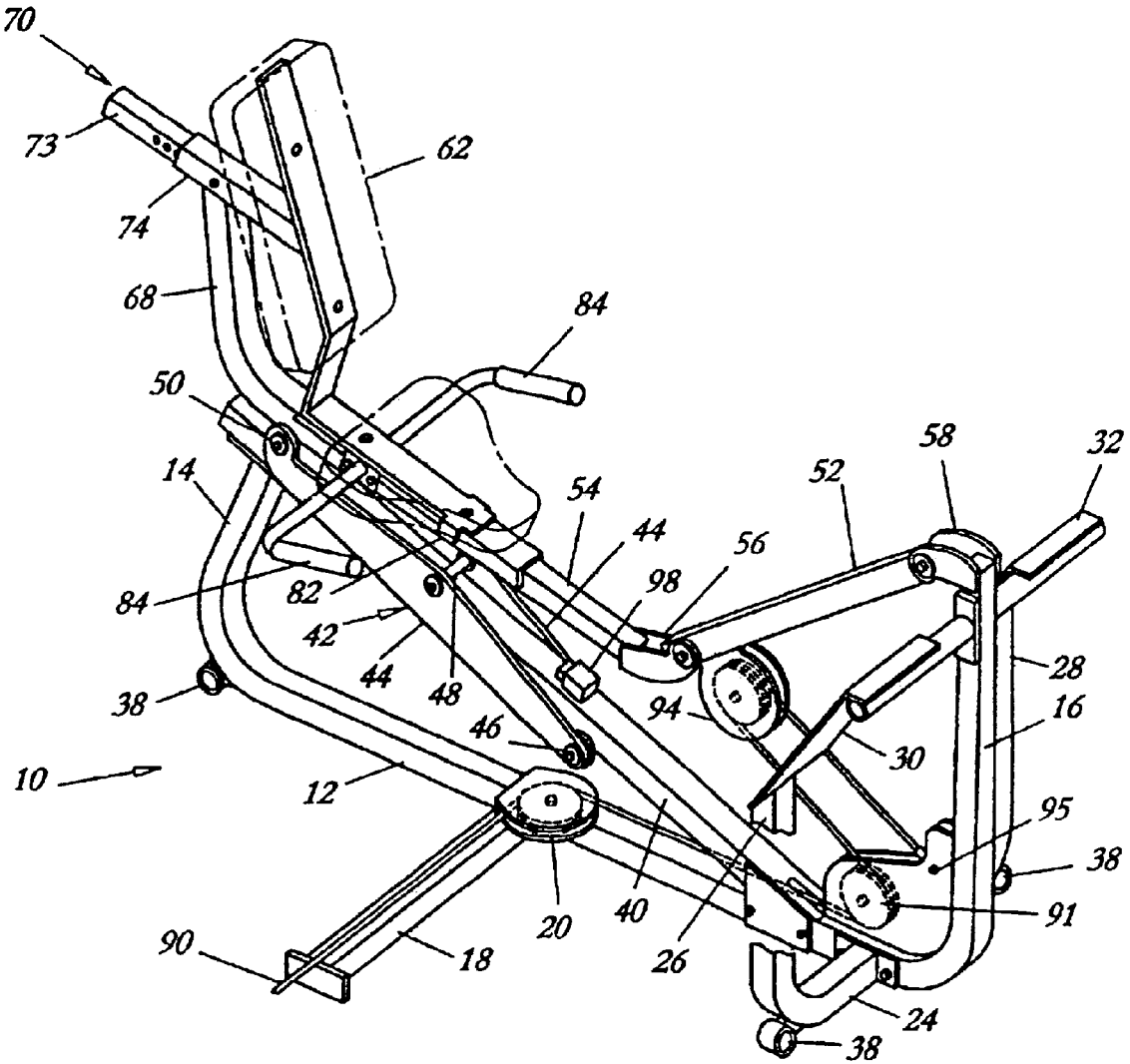
FIG. 4 is a perspective view of the exercise apparatus of the present invention with the apparatus in its extended position, but with the seat removed for clarity.
Figure 5:
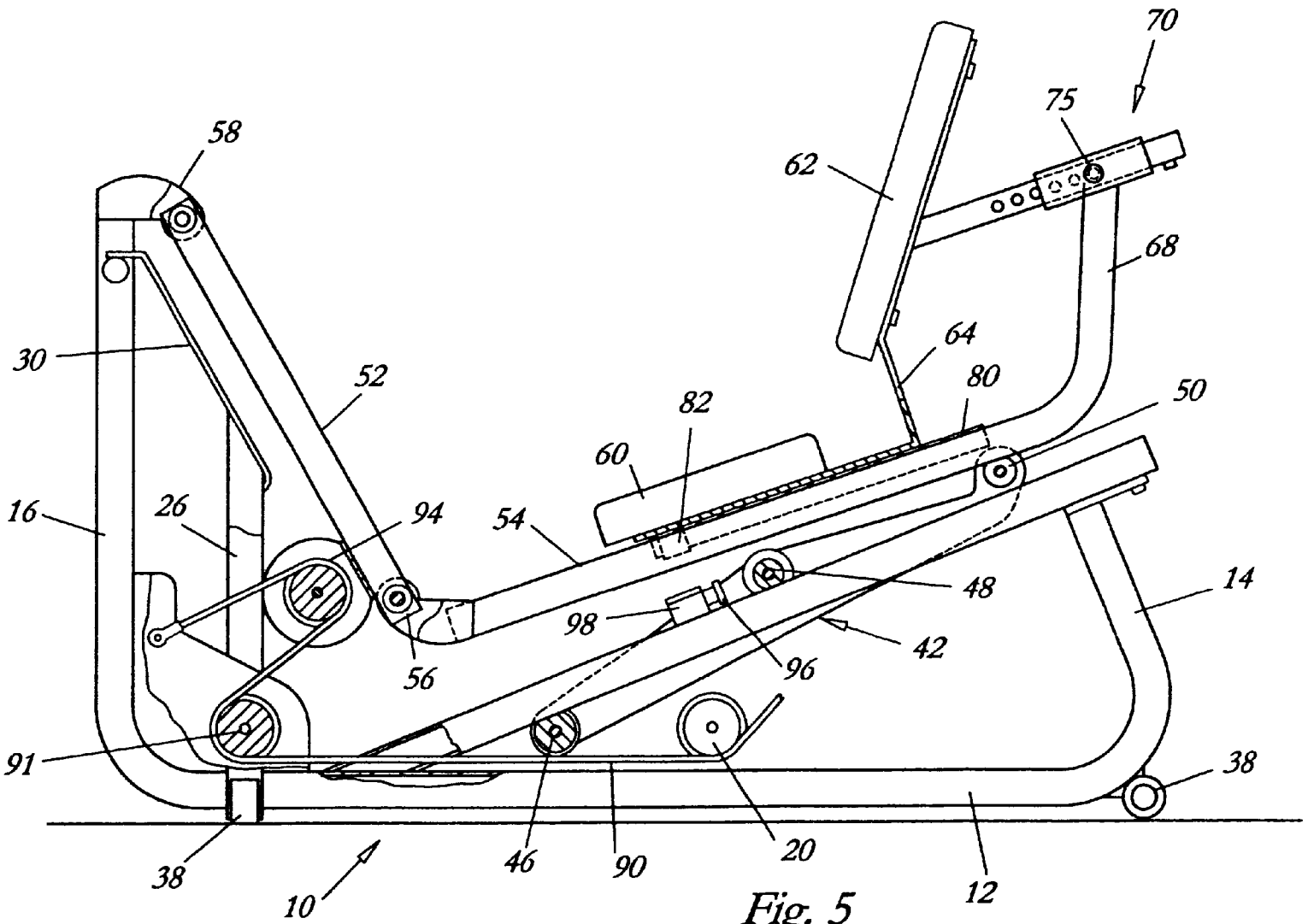
FIG. 5 is a somewhat schematic view of the exercise apparatus similar to that depicted in FIG. 3, but showing further cutaway details.
Figure 6:
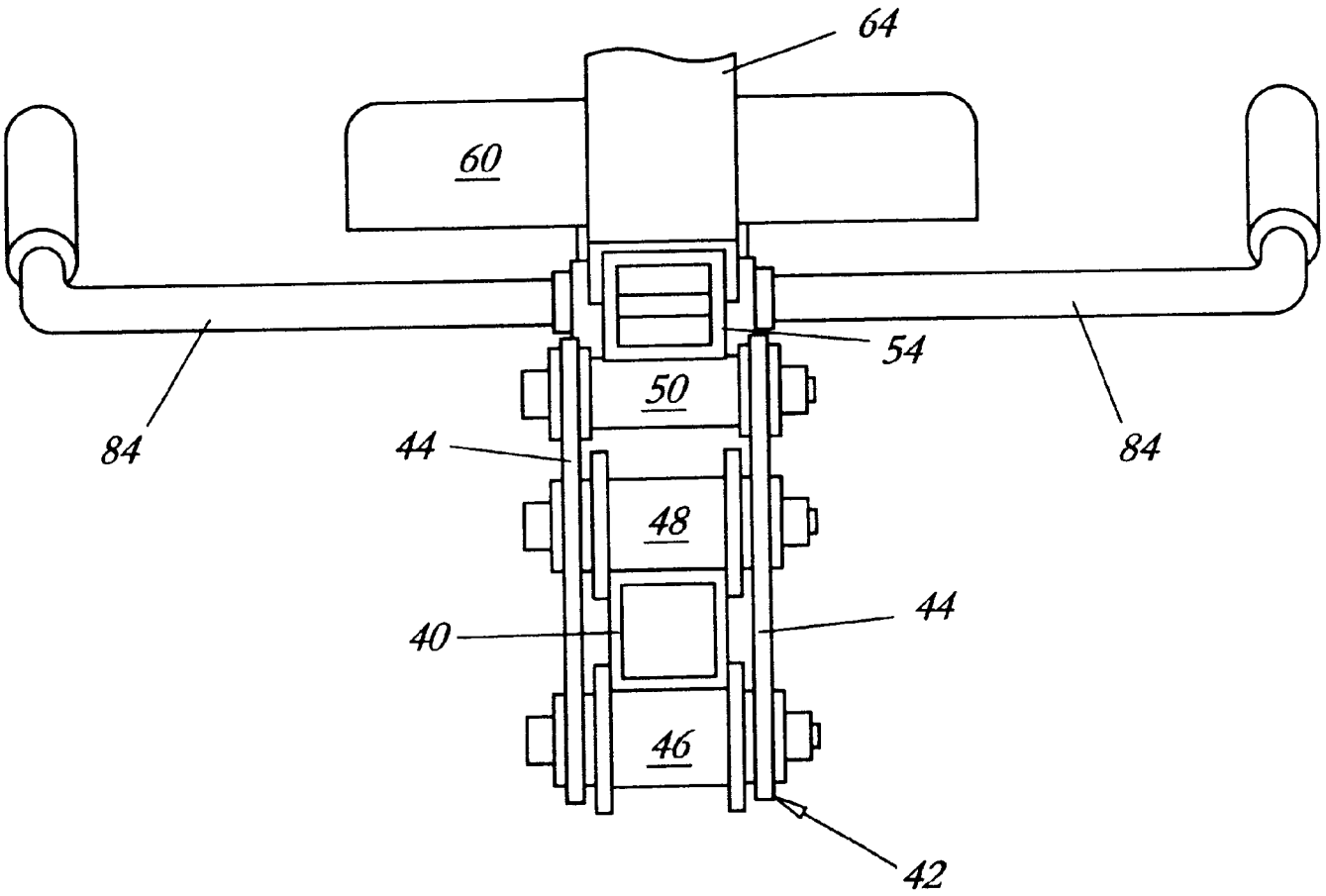
FIG. 6 is a cross-sectional view of the apparatus of FIG. 3 as taken along line 6—6 of FIG. 3.

Also included in the apparatus of the present invention is a seat 60 and its associated backrest 62 attached or rigidly connected to arm 54 such that pivoting of the arm 54 simultaneously pivots seat 60 and backrest 62. A plate 64 may be used for commonly supporting the seat 60 and the backrest 64 such as indicated in FIG. 5. A reference may also be made to the perspective view of FIG. 4 which shows the plate 64 and the seat 60 and the backrest 62 in dotted outline.

It is also noted from the drawings that the arm 54 has an upturned end 68 that supports at its top end an adjustment bar 70 that is affixed to the plate 64 and may be used for adjusting the position of the seat and backrest. For this purpose, the adjustment bar 70 includes an inner-member 73 and an outer-member 74. The inner-member 73 is provided with holes into which a pin 75 may be inserted or threaded so as to hold the seat and backrest in any one of a number of positions along the arm 54. The pin 75 may be a spring loaded pin for adjusting seat position. As also noted in FIG. 5, there may be a slidable channel or plate 80 disposed between the plate 64 and the arm 54 so as to enable the seat mechanism to slide readily on the arm 54. The member 80 may be constructed, for example, of Teflon. For proper support of the seat and backrest, there are also preferably provided side guides 82, such as illustrated in FIGS. 4 and 5. Furthermore, at one of the guides 83, there is disposed outwardly on either side of the arm 54, handlebars 84. In this regard, also note FIG. 1 which shows the user 100 in a seated position on the seat 60 with his back against the backrest 62 and with his hand grasping one of the handlebars 84, that is the one that is visible in FIG. 1.

Now, with further regard to the drawings, and in particular, the perspective view of FIG. 4, there is clearly shown the cable arrangement for providing the resistance to the user. In this regard, for example, in FIGS. 1 and 2, there is shown in dotted outline a multi-station apparatus 88 to which the extension member 18 may be coupled, as indicated, in FIG. 2. A cable 90 may connect in the machine 88 to weights or some other mechanism for providing resistance. But, as indicated, for example, in FIG. 4 of the present application, the cable 90 extends about pulley 20 and from there to a further pulley 91. Pulley 91 is supported between spaced brackets 92 of the frame 10. From there, the cable 90 extends to a further pulley 94 that is rotatable but has its supporting housing fixed directly to arm 52. The cable 90 extends to about pulley 94 and then is secured by means of a pin 95 between the spaced brackets 92. Depending upon the amount of weight that is selected or other form of resistance that is used, as the user moves from the rest position toward an extended position, the weight and cable mechanism impose a force on the user to carry out the exercise in muscle strengthening.

Figure 3:
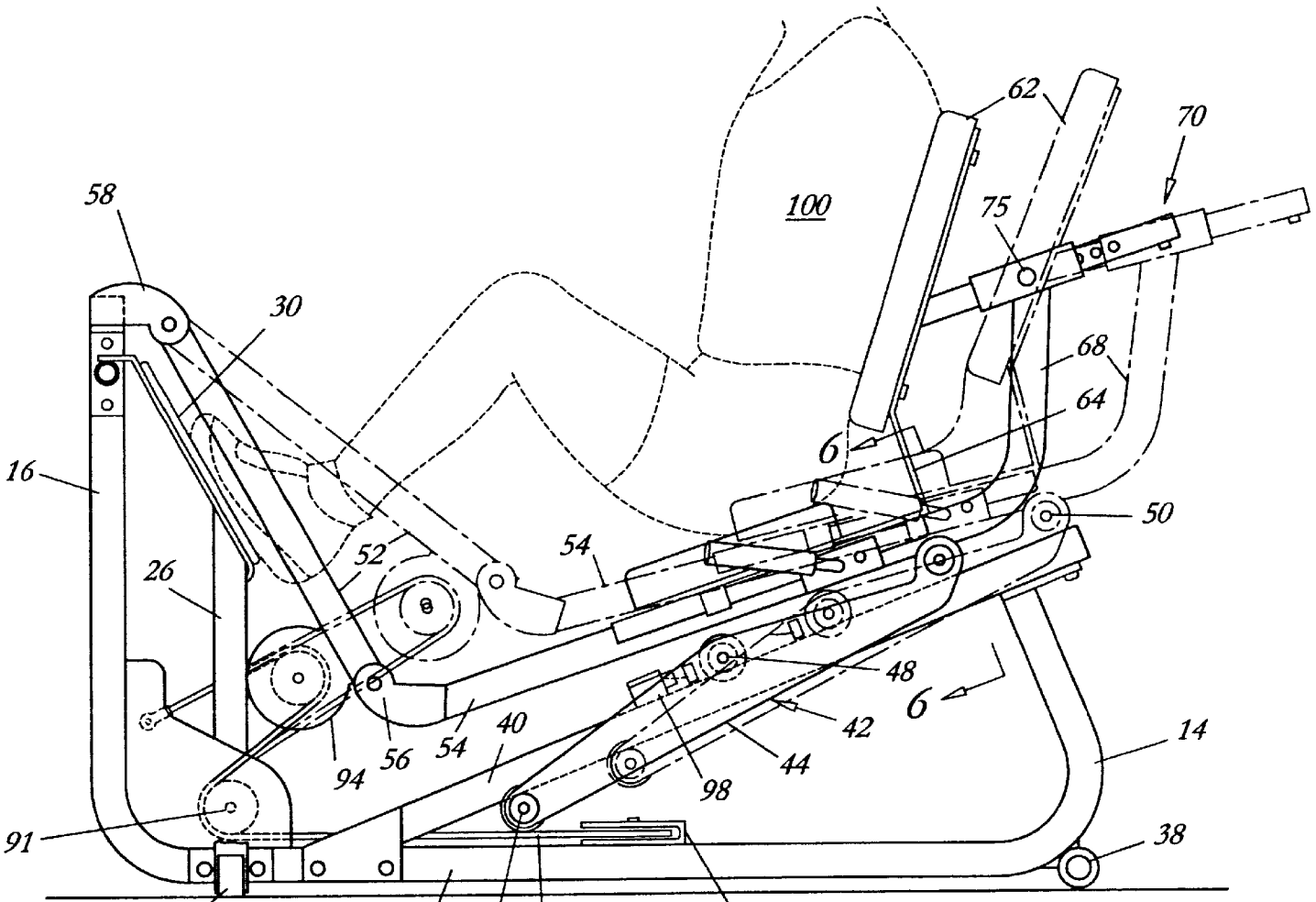
FIG. 3 is an enlarged side elevation view of the apparatus disclosed in FIGS. 1 and 2 and showing the apparatus in rest and extended positions.

Reference may now be made to FIG. 3 that shows, in solid outline, the arms 52 and 54 in a rest position. In this position, the stop plate 96 is resting against the elastomeric stop 98. FIG. 3 also shows, in phantom outline, the arms 52 and 54 pivoted to a more extended position. This would also be similar to the position of the apparatus depicted in the perspective view of FIG. 4 where it is noted that the stop plate 96 is spaced away from the stop 98. FIG. 5 shows the apparatus in its rest position also with the stop 98 engaging the plate 96.

With further reference to FIG. 3, it should also be noted that as the arm 54 moves from the solid position (initial) to the dotted position (extended) in FIG. 3, the attitude of the arm 54 and the seat 60/backrest 62 mounted on the arm 54 and changes relative to the horizontal. This provides a comfortable body position as the user provides leg press action between initial and extended positions. Because the arm 54 is secured at pivot 50, the carriage 42 simply transitions along rail 40 such as between the two positions illustrated in FIG. 3 and the arm 54, seat 60 and backrest 62 pivot backwardly.

With regard to the diagram of FIG. 5, this also clearly indicates the position of the arm 54 in its rest position with the carriage being against a stop. FIG. 5 also illustrates the cable 90 and its transition around the pulleys. It is noted in FIG. 5, that the pulley 20 is shown, for the sake of illustration, vertically disposed when, in actuality, it is horizontally disposed such as illustrated in FIG. 3.

Having now described a preferred embodiment of the present invention, it should now be apparent to those skilled in the art that various other embodiments and modifications thereof, are contemplated as falling within the scope of the present invention. The scope of the invention is to be interpreted by the appended claims.

What is claimed is:

1. Exercise apparatus comprising:

a frame;

a rest member on said frame for receiving a user's feet;

a first arm and a second arm that are pivotably intercoupled to each other at a pivot point such that the arms are pivotably movable between a start position and an extended position;

said first arm coupled to said frame;

seat for supporting a torso of the user and mounted on said second arm;

the seat rotating during movement between the start and the extended positions, the user's torso following rotation of the seat;

an inclined base support member disposed under said second arm for supporting said second arm during movement between the start and extended positions.

2. The apparatus of claim 1 wherein said first arm is pivotably coupled to said frame, the second arm following the inclined base support between the start and extended positions such that the torso of the user is rotated rearwardly relative to horizontal during movement between the start and extended positions.

3. The apparatus of claim 2, wherein said frame includes an upright support piece having at the top end thereof a pivot member for coupling said first arm to said frame.

4. The apparatus of claim 1, further including a pivot member for intercoupling the first and second arms such that the torso of the user is translated rearwardly away from the rest member during movement between the start and extended positions.

5. The apparatus of claim 1, further including a back rest and a common plate for supporting said seat and back rest.

6. The apparatus of claim 1, further including handlebars on either side of said second arm for the support of the user's hands.

7. The apparatus of claim 1, further including a carriage supported on said inclined base support member.

8. The apparatus of claim 7, wherein said carriage at one end thereof includes a pivot member for pivotally supporting the second arm from said carriage.

9. The apparatus of claim 8, wherein said carriage further comprises spacedly disposed side plates interconnected by a lower guide member and an upper guide member.

10. The apparatus of claim 9, further including on the inclined base support member, a stop for defining the start position.

11. Exercise apparatus comprising:

a frame;

a first arm and a second arm that are pivotably intercoupled to each other such that the arms are pivotably movable between a start position and an extended position;

said first arm coupled to said frame;

a seat for supporting a torso of a user and mounted on said second arm;

the first and second arms being intercoupled at a pivot point that rotates the seat mechanism during movement between the start and extended positions;

an inclined base support means; and means for securing said inclined base support means in said frame and under said second arm and for supporting said second arm during the movement between the start and extended positions.

12. The apparatus of claim 11, further including carriage means supported on said inclined base support means.

13. The apparatus of claim 12, further comprising pivot means at one end of said carriage means secured to said second arm for enabling pivoting between said second arm and said carriage means.

14. The apparatus of claim 13, further including stop means for limiting the translation of said carriage means.

15. The apparatus of claim 14, further including pulley means intercoupling said frame and said first arm, in combination with a cable associated with said pulley means for providing a force on said pulley means and, in turn, on said first and second arms.

16. The apparatus of claim 15, wherein said pulley means includes at least one pulley on said frame, and a second pulley on said first arm.

17. A reversibly extending exercise apparatus comprising:

a frame;

a first and a second arm pivotably interconnected to each other at a pivot point such that the interconnected arms are pivotably movable between a start position and an extended position that rotates a seat mounted on one of the arms;

a support defining a predetermined path of travel along which the second arm travels;

wherein a torso of a subject seated within the seat follows rotation of the seat during movement between the start and extended positions.

18. The apparatus of claim 17, further comprising a carriage supported by said rigid support member.

19. The apparatus of claim 18, further including means for pivotably supporting one end of said carriage to said second arm.

20. The apparatus of claim 19, further including a guide means for guiding said carriage on said support member, said guide means being at a lower position relative to said pivot.

21. A reversibly extending leg press apparatus comprising:

a frame;

a pivotably interconnected pair of reversibly extendible arms supported from said frame;

a seat mechanism mounted on one of the arms, the seat mechanism rotating on extension of the arms enabling rotation of a subiect's torso when seated within the seat mechanism;

a support guide mechanism; and means for slidably or rollably supporting one of said arms on said support guide mechanism.

22. The apparatus of claim 21, wherein said pair of arms includes a first arm pivotably supported from said frame and a second arm for engaging with said support guide mechanism.

23. The apparatus of claim 22, further comprising a carriage for intercoupling between said support guide mechanism and said second arm.

24. The apparatus of claim 23, further including pivot means for pivoting said carriage from said second arm at one end of said carriage, the other end of said carriage being engaged with said support guide mechanism.

25. A reversibly extending exercise apparatus comprising:

a pair of pivotably interconnected arms on which a torso of a subject is mountable on a chair mechanism mounted to one of the arms;

a support and guide means forming a part of a frame of the apparatus;

said support and guide means for supporting one of said pair of pivotably interconnected arms;

wherein the arms are reversibly extendible by forcible extension of the legs of the subject between a rest position and an extended position;

the arms being extendible away from each other such that the subject is positioned in an upwardly prone position at all times between the rest and extended positions, the chair mechanism rotating during movement between the rest and extended positions enabling conformation of the subiect's torso to the rotational movement.

26. The apparatus of claim 25, wherein said pair of arms comprise a first arm pivotably connected to said frame and a second arm for engagement with said support and guide means.

27. The apparatus of claim 26, further including a carriage means on said second arm.

28. The apparatus of claim 27, further including pivot means for supporting one end of said second arm from said carriage means.

29. The apparatus of claim 28, further including at least one guide member for guiding said carriage means on said support.

30. The apparatus of claim 29, further including a stop means associated with said support and guide means for limiting the relative position of said second arm on said support and guide means.

* * * * *

UNITED STATES PATENT AND TRADEMARK OFFICE

CERTIFICATE OF CORRECTION

PATENT NO. : 6,743,158 B2
APPLICATION NO. : 09/789071
DATED : June 1, 2004
INVENTOR(S) : Raymond Giannelli et al.

It is certified that error appears in the above-identified patent and that said Letters Patent is hereby corrected as shown below:

On the title page, (73) Assignee:

delete "Cybex Interational, Inc." and insert therefor --Cybex International, Inc.--.

Signed and Sealed this

Thirteenth Day of October, 2009

David J. Kappos

David J. Kappos
*Director of the United States Patent and Trademark Office*